US006050251A

United States Patent [19]

Harwath et al.

[11] Patent Number: 6,050,251

[45] Date of Patent: Apr. 18, 2000

[54] APPARATUS FOR ADJUSTABLY MOUNTING A PIVOTAL ARROW REST

[75] Inventors: Frank A. Harwath, Downers Grove; Miroslav A. Simo, Riverside; Robert S. Mizek, Downers Grove, all of Ill.

[73] Assignee: New Archery Products Corp., Forest Park, Ill.

[21] Appl. No.: 09/226,490

[22] Filed: Jan. 7, 1999

Related U.S. Application Data

[60] Provisional application No. 60/095,133, Aug. 3, 1998.

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,686,956 | 8/1987 | Troncoso, Jr. . | |
| 4,809,670 | 3/1989 | Simo . | |
| 4,827,895 | 5/1989 | Troncoso, Jr. . | |
| 5,070,855 | 12/1991 | Troncoso | 124/44.5 |
| 5,117,803 | 6/1992 | Johnson | 124/44.5 |
| 5,137,006 | 8/1992 | Gallops | 124/44.5 |
| 5,144,937 | 9/1992 | Colvin | 124/44.5 |
| 5,251,606 | 10/1993 | Colvin | 124/44.5 |
| 5,285,764 | 2/1994 | Mertens | 124/44.5 |
| 5,359,984 | 11/1994 | Simo | 124/44.5 |
| 5,372,119 | 12/1994 | Kidney | 124/44.5 |
| 5,490,491 | 2/1996 | Troncoso | 124/44.5 |
| 5,522,375 | 6/1996 | Simo et al. | 124/86 |
| 5,526,799 | 6/1996 | Simo | 124/44.5 |
| 5,722,381 | 3/1998 | Mizek | 124/44.5 |

*Primary Examiner*—John A. Ricci

*Attorney, Agent, or Firm*—Pauley Petersen Kinne & Fejer

[57] ABSTRACT

An apparatus for adjustably mounting an arrow rest with respect to a mounting bracket that attaches to an archery bow. A pivot shaft has a mounting end portion which accepts the arrow rest. The pivot shaft also has an externally threaded end portion which is opposite the mounting end portion. A bearing housing is rotatably mounted with respect to the mounting bracket. The bearing housing has a throughbore and a cavity within which the pivot shaft is rotatably mounted. A tension knob is rotatably mounted within the cavity of the bearing housing. The tension knob also has a throughbore within which the pivot shaft is mounted. A spring is mounted within the cavity of the bearing housing. One end portion of the spring is fixed with respect to the pivot shaft and the opposite end portion of the spring is fixed with respect to the tension knob. A windage knob also has a throughbore within which the pivot shaft extends. At least a portion of the throughbore of the windage knob is internally threaded. Internal threads of the throughbore of the windage knob engage with the external threads of the end portion of the pivot shaft. The arrow rest of this invention can accomplish independent and isolated adjustment of one of the following three parameters, without affecting the setting of the other two of the following three parameters, horizontal movement of the pivot shaft; rotational movement of the pivot shaft; and tension adjustment of the spring.

29 Claims, 6 Drawing Sheets

APPARATUS FOR ADJUSTABLY MOUNTING A PIVOTAL ARROW REST

CROSS REFERENCE TO RELATED APPLICATION

This application claims the benefit of U.S. Provisional Application Ser. No. 60/095,133, filed Aug. 3, 1998.

BACKGROUND OF THE INVENTION

1. Field of the Invention

This invention relates to an arrow rest having three parameters that can be independently adjusted: a spring tension acting upon the arrow rest to return the arrow rest to a normal position; a horizontal or windage position of the arrow rest; and a rotational position of the arrow rest with respect to a mounting bracket.

2. Description of Prior Art

Conventional arrow rest apparatuses allow for rotational adjustment of an arrow rest with respect to a mounting bracket, horizontal or windage adjustment of the arrow rest with respect to the mounting bracket, and spring tension which creates a force used to return the arrow rest to a normal position. However, conventional arrow rests typically do not provide for independent adjustment of each of such parameters. For example, when adjusting a spring tension, conventional arrow rests typically unset or allow free movement of the arrow rest with respect to the mounting bracket. Likewise, conventional arrow rests typically lose the horizontal or windage position of the arrow rest when adjusting the spring tension or when adjusting the radial position of the arrow rest with respect to the mounting bracket.

Conventional arrow rests also allow for adjustment of a rotational position of the arrow rest with respect to the mounting bracket, the horizontal or windage position of the arrow rest with respect to the mounting bracket and the spring tension used to return the arrow rest to its normal position. In view of such conventional arrow rests, it is apparent that there is a need for an arrow rest which can be easily adjusted with independent and isolated control of the spring tension, the horizontal or windage position, and/or the radial position of the anew rest, with respect to the mounting bracket.

SUMMARY OF THE INVENTION

It is one object of this invention to provide an arrow rest that allows for independent and isolated adjustment of a radial position of an arrow rest, a horizontal or windage position of the arrow rest, and/or a spring tension of a force used to return the arrow rest to its normal position, with respect to a mounting bracket or an archery bow.

It is another object of this invention to provide precise micro adjustability of the radial position, the horizontal or windage position and the spring tension of the arrow rest.

It is another object of this invention to provide an arrow rest that gages a change in the radial position, the horizontal or windage position and/or the spring tension.

The above and other objects of this invention are accomplished with an arrow rest having a pivot shaft that moves or translates in a horizontal direction, particularly with respect to a bearing housing which is adjustably fixed with respect to the mounting bracket. The horizontal or windage position of the pivot shaft can be adjusted without rotating the pivot shaft and without altering a previously set spring tension. A lock screw is preferably used to lock the horizontal or windage position of the pivot shaft, once adjusted into a preferred position.

In one preferred embodiment of this invention, an O-ring is positioned between a tension knob and the bearing housing, for example to provide enough frictional contact to overcome a bias force of a spring mounted within the bearing housing.

In one preferred embodiment of this invention, the spring is a coil spring which has one foot or end portion generally fixed with respect to the pivot shaft, and which has an opposite foot or end portion which is generally fixed with respect to the tension knob. Preferably, the one end portion of the spring, fixed with respect to the pivot shaft, is mounted within a stop washer which has two inwardly directed tabs that engage within corresponding longitudinal slots of the pivot shaft.

The arrow rest used in connection with the apparatus of this invention is preferably but not necessarily a shoot-thru type arrow rest that has support arms adjustable in a vertical direction and a horizontal direction. The arrow rest can have two support arms mounted with respect to the pivot shaft, such as in any suitable manner known to those skilled in the art.

The mounting bracket is preferably mounted to an archery bow riser using conventional and industry standard connections. The support arms support an arrow shaft which in a normal loaded position is set and ready for launch. As the arrow shaft launches, the support arms pivot against a predetermined set spring tension, which can be easily adjusted using the arrow rest apparatus of this invention.

The support arms are adjustably positioned with respect to the mounting bracket by engaging or operating a windage knob, a lock screw engagable with the windage knob and/or a worm gear. As the windage knob is rotated, the support arms translate or move in a horizontal direction with respect to the mounting bracket. As the worm gear is rotated, the support arms rotate to change the radial position and thus the vertical position of the support arm with respect to the mounting bracket. A set screw can be used to lock the windage knob with respect to the mounting bracket, once in a set position.

The pivot shaft is mounted within a throughbore of a stop washer. The stop washer preferably has inwardly directed tabs that mount within corresponding longitudinal slots of the pivot shaft. One end portion of the spring is fixedly mounted with respect to the stop washer. The opposite end portion of the spring is fixedly mounted with respect to the tension knob. Thus, as the tension knob rotates, the pivot shaft moves or translates along a longitudinal axis of the pivot shaft but does not rotate about the longitudinal axis. This enables the horizontal position of the pivot shaft to be varied without changing the radial position of the arrow rest with respect to the mounting bracket. With the horizontal adjustment according to this invention, the pivot shaft does not extend or protrude beyond the tension knob.

An exterior area of the bearing housing preferably has a circumferential row of worm threads. A worm screw or worm gear is rotatably mounted within a bore of the mounting bracket, so that the worm screw engages the worm threads to rotate the bearing housing with respect to the mounting bracket, upon rotation of the worm screw. Once rotated into a preferred position, the mounting bracket can be clamped tightly over the bearing housing and/or the worm screw can be locked with a set screw, to fix the radial or the vertical position of the support arms.

The different elements of this invention are preferably but not necessarily constructed of a lightweight metal polymeric material or any other suitable material including metal, plastic, graphite or composite material that is preferably lightweight, rigid and structurally sound.

BRIEF DESCRIPTION OF THE DRAWINGS

The above-mentioned and other features and objects of this invention will be better understood from the following detailed description when taken in view of the drawings wherein.

DESCRIPTION OF PREFERRED EMBODIMENTS

Figure 2:
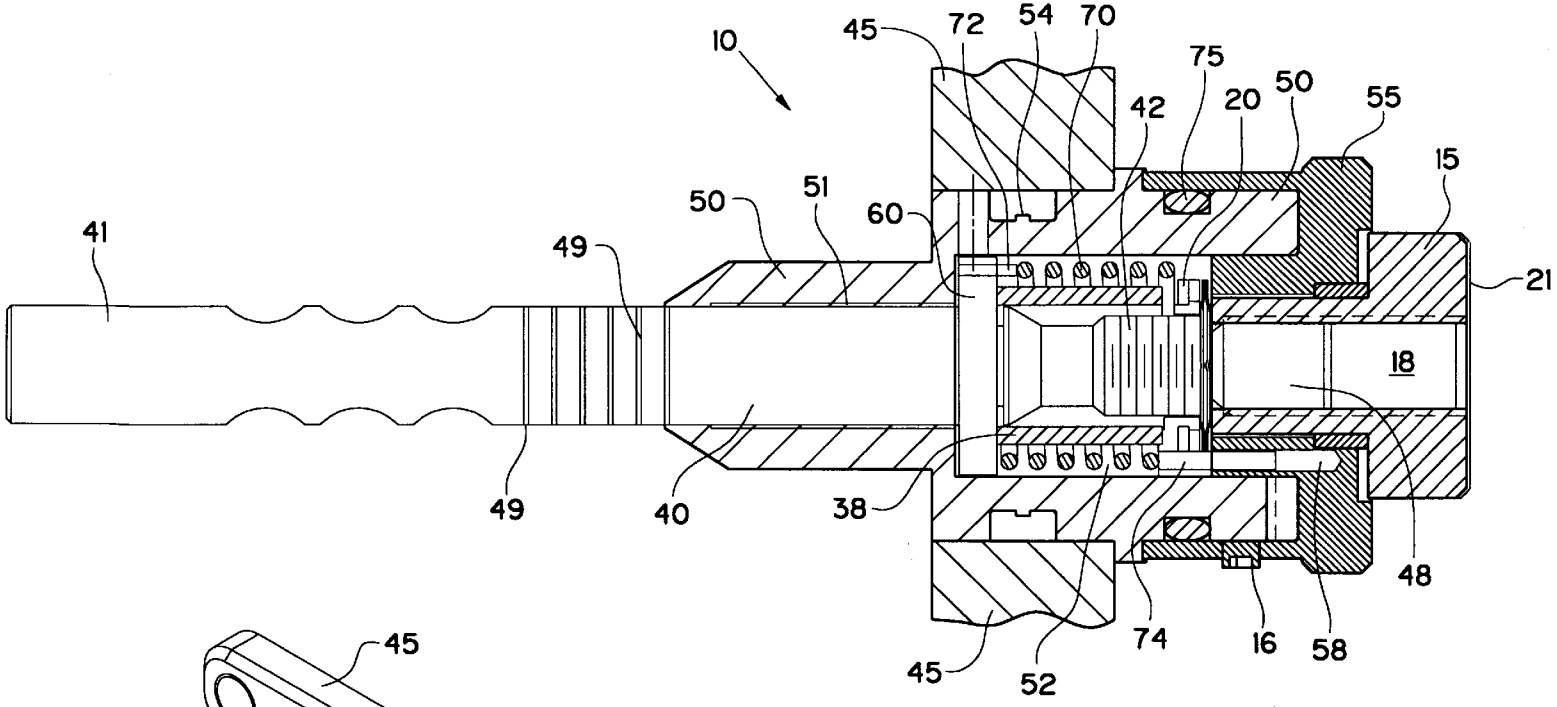
FIG. 2 is a sectional view of a pivot shaft, a bearing housing, a tension knob and a windage knob, assembled according to one preferred embodiment of this invention.
Figure 1:
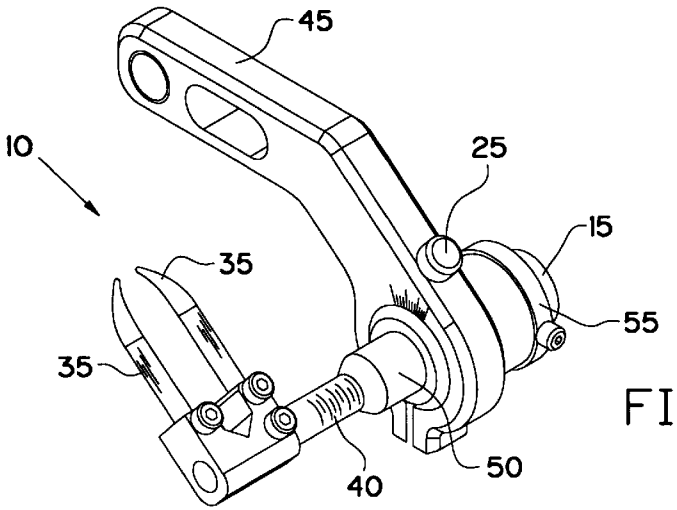
FIG. 1 is a perspective view of an arrow rest apparatus, according to one preferred embodiment of this invention.

FIG. 1 shows a perspective view of arrow rest 10, according to one preferred embodiment of this invention. FIG. 2 shows a sectional view taken along a centerline of an assembly comprising pivot shaft 40 mounted within windage knob 15, bearing housing 50 and tension knob 55, according to one preferred embodiment of this invention. When assembled as shown in FIGS. 1 and 2, arrow rest 10 of this invention provides independent control of: adjustment of a radial position of support arms 35, without changing the horizontal or windage position of pivot shaft 40 and without changing the tension of spring 70; adjustment of a horizontal position or a windage position of pivot shaft 40, without changing the rotational position of support arms 35 and without changing the tension of spring 70; and/or adjustment of the tension of spring 70 without changing the radial position of support arms 35 and without changing the horizontal position or the windage position of pivot shaft 40.

As used throughout this specification and in the claims, the phrase horizontal position or windage position relates to movement of pivot shaft 40 and thus of support arms 35 in a horizontal or left-right direction, as shown in FIG. 2. When an archery bow is held in a shooting position, mounting bracket 45 is in a vertical position and thus pivot shaft 40 is in a horizontal position, as shown in FIG. 2. Thus, when the term horizontal is used throughout this specification and in the claims, it is intended to relate to the direction that pivot shaft 40 moves or translates, along a longitudinal axis of pivot shaft 40, when an archery bow is held in a vertical position and mounting bracket 45 is thus in a vertical position.

Figure 9:
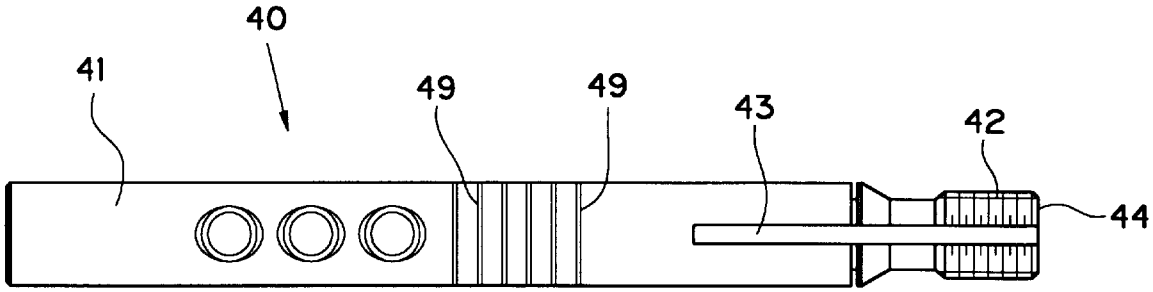
FIG. 9 is top view of the pivot shaft as shown in FIG. 6.
Figure 6:
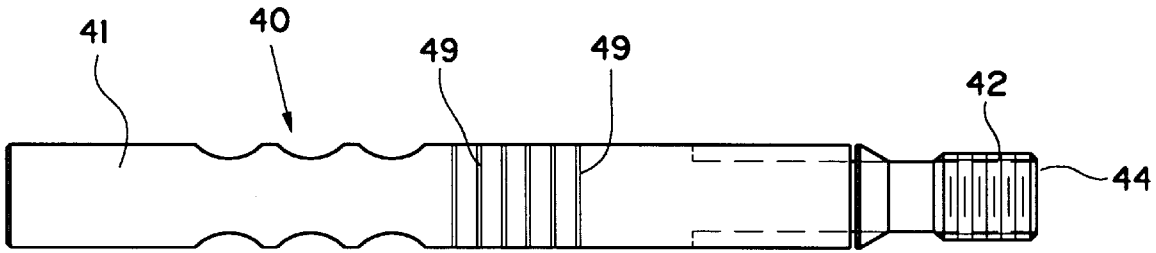
FIG. 6 is a rear view of a pivot shaft, according to one preferred embodiment of this invention.

In one preferred embodiment according to this invention, arrow rest 10 comprises pivot shaft 40 having mounting end portion 41 and externally threaded end portion 42 which is opposite mounting end portion 41, as shown in FIGS. 6 and 9. Externally threaded end portion 42 is preferably but not necessarily externally threaded as far as one end face of pivot shaft 40, as shown in FIGS. 6 and 9. However, it is apparent that only a portion of externally threaded end portion 42 is preferably threaded, depending upon the particular design of pivot shaft 40, as long as it remains possible to accomplish the same result of engaging the external threads of end portion 42 with the internal threads of windage knob 15, as discussed later in this specification.

In one preferred embodiment of this invention, pivot shaft 40 has at least one longitudinal slot 43 at or near externally threaded end portion 42. It is apparent that depending upon the design of windage knob 15, pivot shaft 14 can have end portion 42 with internal threads, to act in a reverse role.

Figure 19:
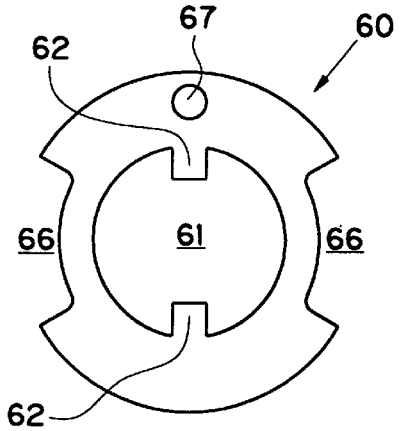
FIG. 19 is a side view of a stop washer, according to one preferred embodiment of this invention.
Figure 20:
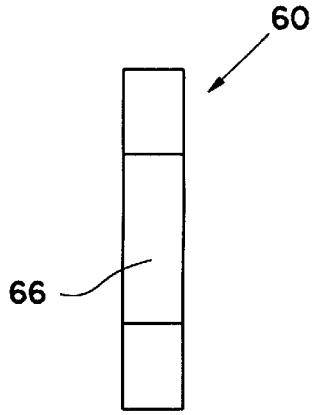
FIG. 20 is a rear view of the stop washer as shown in FIG. 19.
Figure 22:
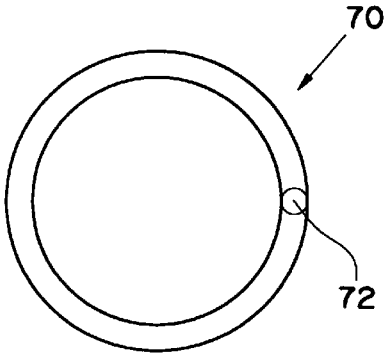
FIG. 22 is a left side view of the coil spring as shown in FIG. 21.
Figure 21:
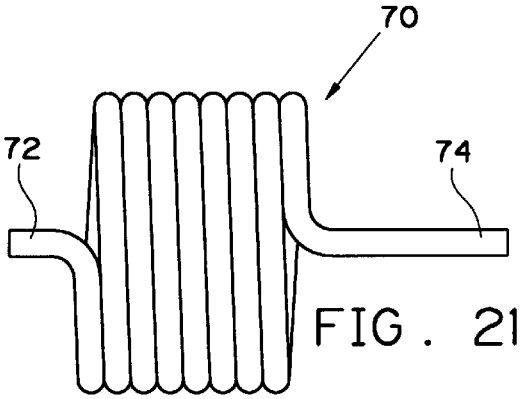
FIG. 21 is a rear view of a coil spring, according to one preferred embodiment of this invention.
Figure 26:
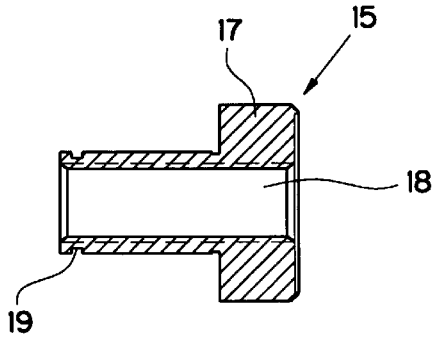
FIG. 26 is a sectional view of the windage knob as shown in FIG. 23.
Figure 24:
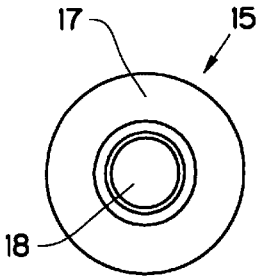
FIG. 24 is a left side view of the windage knob as shown in FIG. 23.
Figure 23:
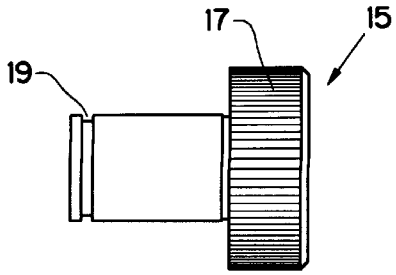
FIG. 23 is a rear view of a windage knob, according to one preferred embodiment of this invention.
Figure 25:
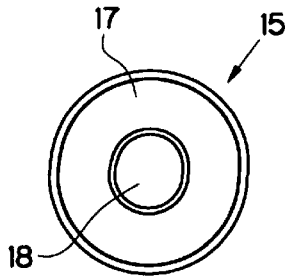
FIG. 25 is a right side view of the windage knob as shown in FIG. 23.

As shown in FIGS. 6–9, pivot shaft 40 has two longitudinal slots 43. FIG. 19 shows stop washer 60 with inwardly directed tabs 62. As shown in FIG. 19, stop washer 60 has two inwardly directed tabs 62 that mount within corresponding longitudinal slots 43 of pivot shaft 40. FIG. 2 shows the assembled position of stop washer 60. Pivot shaft 40 is mounted within throughbore 61 of stop washer 60. Thus, stop washer 60 can move in a longitudinal direction along pivot shaft 40, but is prevented from rotation about the longitudinal axis of pivot shaft 40 because of tabs 62 on stop washer 60.

Figure 8:
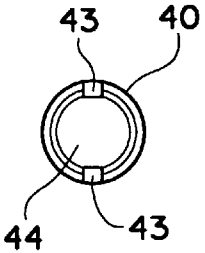
FIG. 8 is a right side view of the pivot shaft as shown in FIG. 6.
Figure 7:
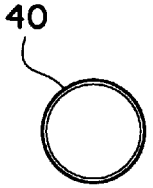
FIG. 7 is a left side view of the pivot shaft as shown in FIG. 6.
Figure 12:
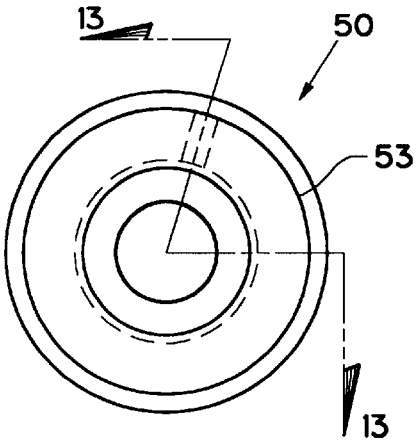
FIG. 12 is a left side view of the bearing housing as shown in FIG. 10.

Pivot shaft 40 preferably has two diametrically opposed longitudinal slots 43, as shown in FIG. 8. However, it is apparent that any other suitable position of one or more longitudinal slots 43 can be used to prevent rotational movement of stop washer 60 with respect to pivot shaft 40, while allowing longitudinal movement of stop washer 60 with respect to pivot shaft 40.

Figure 13:
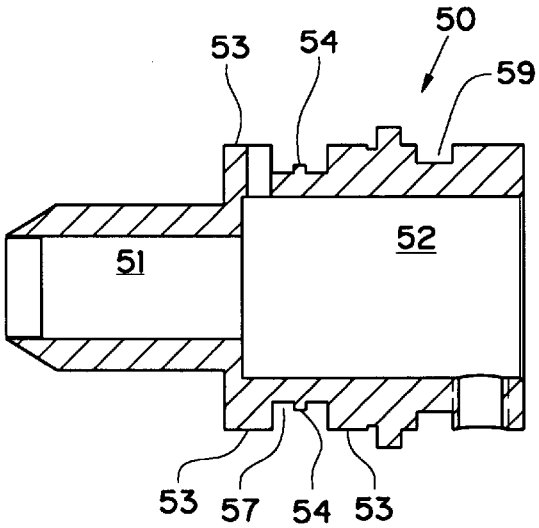
FIG. 13 is a sectional view, taken along line 13—13, as shown in FIG. 12, of the bearing housing as shown in FIG. 10.
Figure 11:
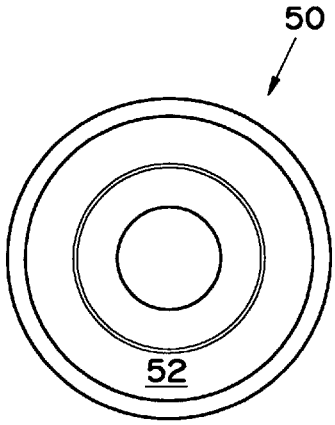
FIG. 11 is a right side view of the bearing housing as shown in FIG. 10.
Figure 17:
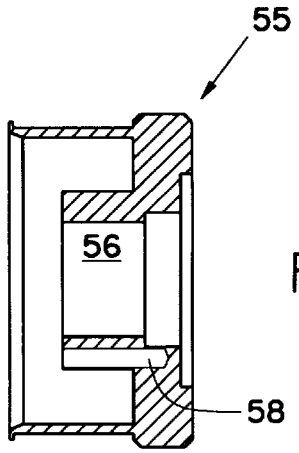
FIG. 17 is a sectional view of the tension knob as shown in FIG. 14.
Figure 15:
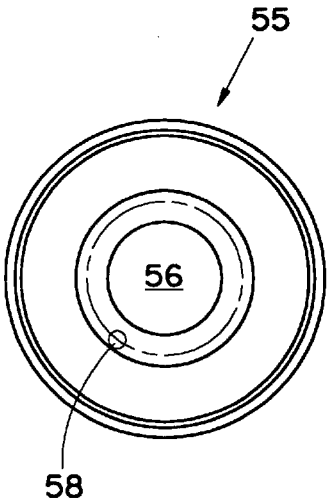
FIG. 15 is a left side view of the tension knob as shown in FIG. 14.
Figure 14:
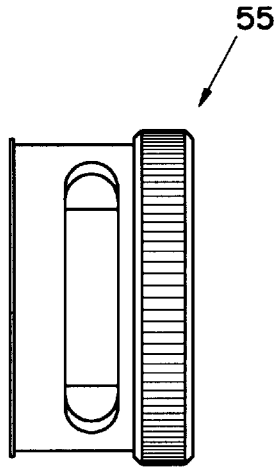
FIG. 14 is a rear view of a tension knob, according to one preferred embodiment of this invention.
Figure 16:
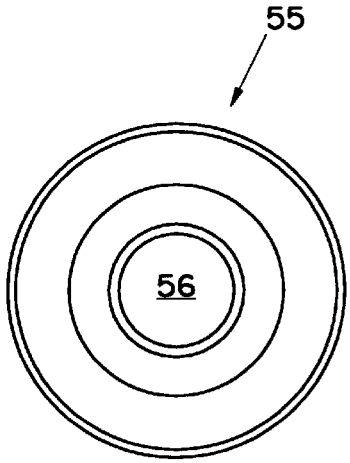
FIG. 16 is a right side view of the tension knob as shown in FIG. 14.

As shown in FIG. 13, throughbore 51 and cavity 52 preferably communicate with each other, so that pivot shaft 40 can extend beyond throughbore 51 and into cavity 52. As shown in FIG. 2, spring 70 is preferably a coil spring which is mounted within cavity 52. Spring 70 is preferably positioned about pivot shaft 40. In one preferred embodiment of this invention, as shown in FIG. 2, sleeve 38 is positioned between spring 70 and pivot shaft 40, for example to provide smoother movement of tension knob 55 when adjusting the tension of spring 70. Sleeve 38 can be removed and still maintain the operability of arrow rest 10 according to this invention.

Figure 5:
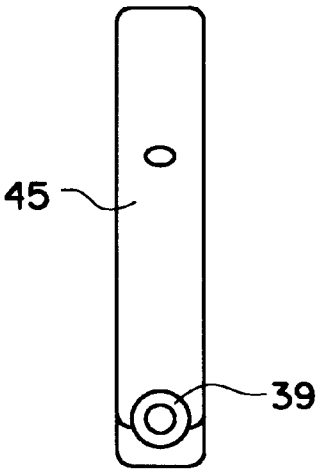
FIG. 5 is a rear view of the mounting bracket as shown in FIG. 3.
Figure 3:
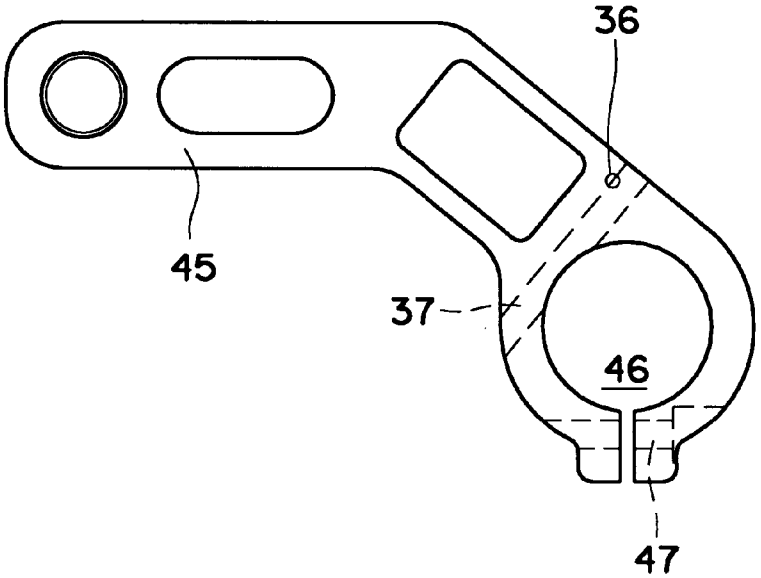
FIG. 3 is a side view of a mounting bracket, according to one preferred embodiment of this invention.
Figure 4:
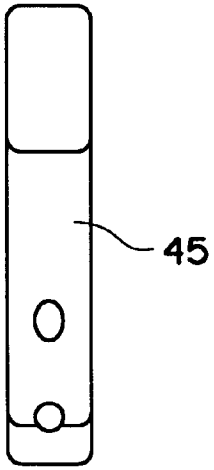
FIG. 4 is a front view of the mounting bracket as shown in FIG. 3.

As shown in FIGS. 1 and 2, bearing housing 50 has barrel portion 53 which is rotatably mounted within bracket bore 46, as shown in FIG. 3, of mounting bracket 45. Mounting bracket 45 preferably but not necessarily forms a split ring about bore 46 as shown in FIG. 5. Screw 39 engageable within bore 47, shown in FIG. 3, can be used to compress and thus tighten the split ring of mounting bracket 45. Screw 39 can also be used to set the radial position of support arms 35, for example after worm gear 25 is used to rotate bearing housing 50 with respect to mounting bracket 45.

Figure 10:
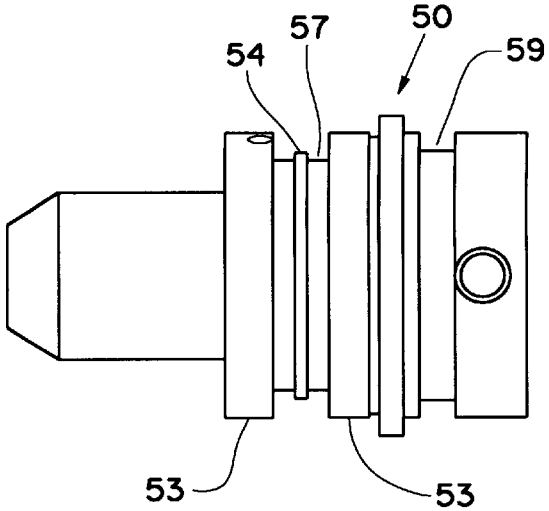
FIG. 10 is a rear view of a bearing housing, according to one preferred embodiment of this invention.
Figure 18:
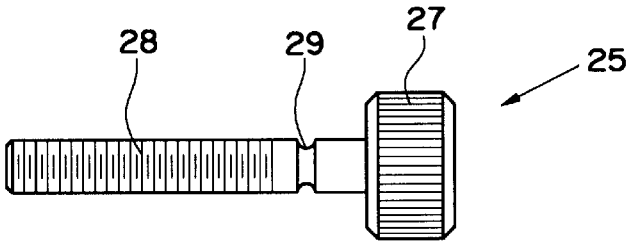
FIG. 18 is a front view of a worm gear, according to one preferred embodiment of this invention.

As shown in FIG. 3, threaded bore 37 of mounting bracket 45 engageably accepts worm gear 25, such as shown in FIG. 18. Worm gear 25 can be rotated so that external threads of threaded portion 28 engage with worm threads 54, as shown in FIGS. 10 and 13 within circumferential groove 57 of bearing housing 50. As worm gear 25 rotates, a worm gear effect between worm gear 25 and worm threads 54 rotate bearing housing 50 with respect to mounting bracket 45. As shown in FIG. 1, indicator marks can be used to gage the radial position of bearing housing 50 with respect to mounting bracket 45.

FIG. 3 shows bore 36 within mounting bracket 45. A set screw, for example, can be threadedly engaged within bore 36, which is preferably internally threaded. A tip of the set screw can be positioned within circumferential groove 29, as shown in FIG. 18, of worm gear 25. The set screw within bore 36 can be used to prevent rotational movement of worm gear 25 with respect to mounting bracket 45.

Tension knob 55 is rotatably mounted within cavity 52 of bearing housing 50, such as shown in FIG. 2. Tension knob 55 comprises throughbore 56. Once in position, C-ring 20 can be clamped within circumferential groove 19 of windage knob 15 to retain windage knob 15 in a mounted position.

O-ring 75 can be positioned within a circumferential groove, such as circumferential groove 59 of bearing housing 50, as shown in FIG. 13, or can be positioned within a circumferential groove within tension knob 55, not shown in the drawings, generally adjacent to circumferential groove 59.

FIGS. 2, 6 and 9 show pivot shaft 40 comprising a plurality of spaced apart circumferential grooves 49, which can be used as sight indicators to gage the distance that pivot shaft 40 moves in a horizontal direction with respect to mounting bracket 45 and/or bearing housing 50.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of the invention.

We claim:

1. An apparatus for adjustably mounting an arrow rest with respect to a mounting bracket that attaches to an archery bow, the apparatus comprising:

a pivot shaft having a mounting end portion accepting the arrow rest, said pivot shaft having an externally threaded end portion opposite said mounting end portion;

a bearing housing having a first throughbore and a first cavity, said pivot shaft rotatably mounted within said first throughbore, said bearing housing rotatably mounted with respect to the mounting bracket;

a tension knob rotatably mounted within said first cavity, said tension knob having a second throughbore;

a spring having a first end portion fixed with respect to said pivot shaft and a second end portion fixed with respect to said tension knob; and a windage knob having a third throughbore, said third throughbore at least partially internally threaded, internal threads of said at least partially threaded portion of said third throughbore engageable with said externally threaded end portion of said pivot shaft.

2. An apparatus according to claim 1 wherein said pivot shaft has at least one longitudinal slot near said externally threaded end portion.

3. An apparatus according to claim 2 further comprising a stop washer having a fourth throughbore and at least one radial inwardly directed tab, said pivot shaft mounted within said fourth throughbore, and said at least one tab mounted within said at least one longitudinal slot.

4. An apparatus according to claim 3 wherein said pivot shaft has two said longitudinal slots diametrically opposed with respect to each other and said stop washer has; two said tabs each mounted within a corresponding longitudinal slot of said longitudinal slots.

5. An apparatus according to claim 3 wherein said stop washer has a bore and said first end portion of said spring is mounted within said bore.

6. An apparatus according to claim 1 further comprising a stop washer having a fourth throughbore, said pivot shaft mounted within said fourth throughbore, said stop washer rotationally fixed with respect to said pivot shaft, said stop washer having a bore and said first end portion of said spring mounted within said bore.

7. An apparatus according to claim 1 wherein said first throughbore and said first cavity are in communication with each other.

8. An apparatus according to claim 1 wherein said bearing housing has a cylindrical barrel portion rotatably mounted within a bracket bore of the mounting bracket.

9. An apparatus according to claim 8 wherein said bearing housing has a circumferential groove and a worm thread is positioned within said circumferential groove.

10. An apparatus according to claim 9 further comprising a worm gear rotatably mounted with respect to the mounting bracket, and said worm gear engageable with said worm thread of said bearing housing.

11. An apparatus according to claim 1 wherein said tension knob has a circumferential groove positioned within said first cavity.

12. An apparatus according to claim 11 further comprising a tension lock mounted with respect to the mounting bracket and lockingly engageable with said tension knob and preventing movement of said tension knob with respect to said bearing housing.

13. An apparatus according to claim 12 wherein said tension lock comprises a set screw mounted within an internally threaded bore of said bearing housing.

14. An apparatus according to claim 1 wherein said windage knob has a circumferential groove and a C-ring is positioned within said circumferential groove and clipped over said windage knob.

15. An apparatus according to claim 1 wherein said tension knob has a bore and said second end portion of said spring is mounted within said bore.

16. An apparatus according to claim 1 wherein said spring is a coil spring coiled about said pivot shaft.

17. An apparatus according to claim 1 wherein an end face of said externally threaded end portion of said pivot shaft has a bore with a noncircular cross section, and said bore is accessible through said third throughbore of said windage knob.

18. An apparatus according to claim 1 further comprising a lock screw having external threads engageable with said internal threads of said at least partially threaded portion of said third throughbore.

19. An apparatus according to claim 1 further comprising an O-ring positioned between and abutting said bearing housing and said tension knob.

20. An apparatus according to claim 19 wherein an external surface of said bearing housing has a circumferential groove and said O-ring is mounted within said circumferential groove.

21. An apparatus according to claim 19 wherein an internal surface of said tension knob has a circumferential groove and said O-ring is mounted within said circumferential groove.

22. An apparatus according to claim 1 further comprising a sleeve positioned within said first cavity of said bearing housing, said spring surrounding an external surface of said sleeve, said sleeve having a fourth throughbore, and said pivot shaft mounted within said fourth throughbore.

23. An apparatus according to claim 1 wherein said pivot shaft has a plurality of spaced apart circumferential grooves.

24. An apparatus according to claim 1 wherein said pivot shaft has a plurality of sight indicators to gage a distance that said pivot shaft moves in a horizontal direction with respect to said bearing housing.

25. An apparatus for adjustably mounting an arrow rest with respect to a mounting bracket that attaches to an archery bow, the apparatus comprising:

a pivot shaft having a mounting end portion accepting the arrow rest, a bearing housing having a first throughbore and a first cavity, said pivot shaft rotatably mounted within said first throughbore, said bearing housing rotatably mounted with respect to the mounting bracket, said bearing housing having a cylindrical barrel portion rotatably mounted within a bracket bore of the mounting bracket, said bearing housing having a circumferential groove and a worm thread positioned within said circumferential groove.

26. An apparatus according to claim 25 further comprising a worm gear rotatably mounted with respect to the mounting bracket, and said worm gear engageable with said worm thread.

27. An apparatus for adjustably mounting an arrow rest with respect to a mounting bracket that attaches to an archery bow, the apparatus comprising:

a pivot shaft having a mounting end portion accepting the arrow rest, said pivot shaft having an externally threaded end portion opposite said mounting end portion;

a bearing housing having a first throughbore and a first cavity, said pivot shaft rotatably mounted within said first throughbore, said bearing housing rotatably mounted with respect to the mounting bracket;

a tension knob rotatably mounted within said first cavity, said tension knob having a second throughbore;

a spring mounted within said first cavity, said spring having one end portion fixed with respect to said pivot shaft and an opposite end portion fixed with respect to said tension knob; and an O-ring positioned between and abutting said bearing housing and said tension knob.

28. An apparatus according to claim 27 wherein an external surface of said bearing housing has a circumferential groove and said O-ring is mounted within said circumferential groove.

29. An apparatus according to claim 27 wherein an internal surface of said tension knob has a circumferential groove and said O-ring is mounted within said circumferential groove.

* * * * *